US005484637A

United States Patent [19]

Paragon et al.

[11] Patent Number: 5,484,637

[45] Date of Patent: Jan. 16, 1996

[54] TEMPERED GLASS ARTIST PALETTES

[76] Inventors: Michael Paragon, 852 17th St., Suite 6, Santa Monica, Calif. 90403; Barbara Ragagli, 8600 Tuscany Ave., #304, Playa Del Rey, Calif. 90293

[21] Appl. No.: 314,342

[22] Filed: Sep. 28, 1994

[51] Int. Cl.[6] ..... B44D 3/02

[52] U.S. Cl. ..... 428/66.6; 206/1.7; 206/1.8; 206/1.9; 428/80; 428/137; 428/195; 428/201; 428/203; 428/210; 428/220; 428/426; 428/442

[58] Field of Search ..... 428/64, 66, 80, 428/131, 137, 195, 203, 201, 210, 220, 426, 442; 206/1.7, 1.9, 1.8

[56] References Cited

U.S. PATENT DOCUMENTS

| | | | |
|---|---|---|---|
| 2,124,810 | 7/1938 | Allman | 206/1.7 |
| 2,402,850 | 6/1946 | Sillman | 206/1.7 |
| 5,169,694 | 12/1992 | Endo | 428/34 |
| 5,249,667 | 10/1993 | Hill | 206/1.7 |

FOREIGN PATENT DOCUMENTS

| | | | |
|---|---|---|---|
| 1579828 | 11/1980 | United Kingdom | 206/1.7 |

*Primary Examiner*—Nasser Ahmad
*Attorney, Agent, or Firm*—A. M. Fernandez

[57] ABSTRACT

Palettes are made from a sheet of translucent tempered glass and, except for table-top palettes (although optionally there also), provided with a textured surface or a sheet of white vinyl laminated on the backside of the sheet. A thumb hole is provided on hand-held palettes of quasi-elliptical shape for securing the palette on an arm of the artist, and a hand-hold opening is optionally provided on table-top palettes of rectangular shape. All of the palettes disclosed may have a color mixing guide or chart printed on one surface or the other at the interface of the sheet of tempered glass and the white vinyl, or optionally on the surface of the backside of the tempered glass when made without a textured surface for a table-top palette. The table top provides the diffused light illumination of paint on the palette from the backside. A palette of classic shape is shown to illustrate the invention which may be practiced with other unique shapes illustrated.

8 Claims, 3 Drawing Sheets

TEMPERED GLASS ARTIST PALETTES

FIELD OF THE INVENTION

The invention relates to artist palettes and to rigid translucent surfaces in general used for mixing various paint colors. More particularly, it relates to a rigid translucent palettes (hand held or table top) that, unlike any other surface is easily cleaned and restored to its original pristine state.

BACKGROUND OF THE INVENTION

The use of rigid surfaces by artists for mixing paint colors is well known. However, the materials and textures of the surfaces vary. Traditionally, artists apply and mix paint on a palette made in various shapes with thumb holes specifically for them to hold while they stand or sit before an easel to transfer paint to another surface, such as a canvas supported by the easel. The variety of palette surfaces and materials sold include aluminum, wood, masonite, plastic, plexiglas, porcelain, waved paper and a variety of other flat surfaces in manageable shapes and sizes. These materials of commercially available palettes are difficult and in most cases impossible to clean once paint has dried on the surface, for example, oil or acrylic paints, and miscellaneous inks.

These commercially available palettes are not capable of providing the user with a completely reusable paint mixing surface which is impervious to nicks and scratches that impede the flowing of colors during the mixing process and cause wear and tear on the artists' brushes. Thus, a need exists for a palette with a completely smooth and rigid translucent surface on which colors (paints or inks) are easily and randomly mixed and easily cleaned after the paints or inks are dried.

STATEMENT OF THE INVENTION

In accordance with the present invention, a rigid translucent palette (hand held or table top) is formed using a sheet of tempered glass either with a white vinyl layer laminated on the back to reflect light entering the glass from the front or a textured surface on the back to diffuse light entering from the back of the palette. In the case of using a vinyl layer, it may be prepared with a printed color mixing guide before it is laminated, preferably a color chart of primary color rings for red, yellow and blue disposed on the palette with their centers spaced 120° apart and secondary color rings for green, purple and orange disposed on the palette with their centers centered between the primary color rings such that where the primary and a second ring overlap, additional colors of blue green, blue purple, red purple, red orange, yellow orange and yellow green are indicated, and where both primary and secondary color rings overlap still other colors are indicated, namely dark green, dark purple, ruse, dark orange, citron and olive are indicated, all as a guide for mixing three primary and three secondary colors to obtain 18 different colors. For hand-held palettes, a thumb hole is provided to facilitate holding the palette on an arm while the other arm is used for painting in a conventional manner, but for a table-top palette there need be no hole unless one is desired large enough to fit the hand for carrying.

The novel features that are considered characteristic of this invention are set forth with particularity in the appended claims. The invention will best be understood from the following description when read in connection with the accompanying drawings.

DETAILED DESCRIPTION OF THE INVENTION

Figure 1:
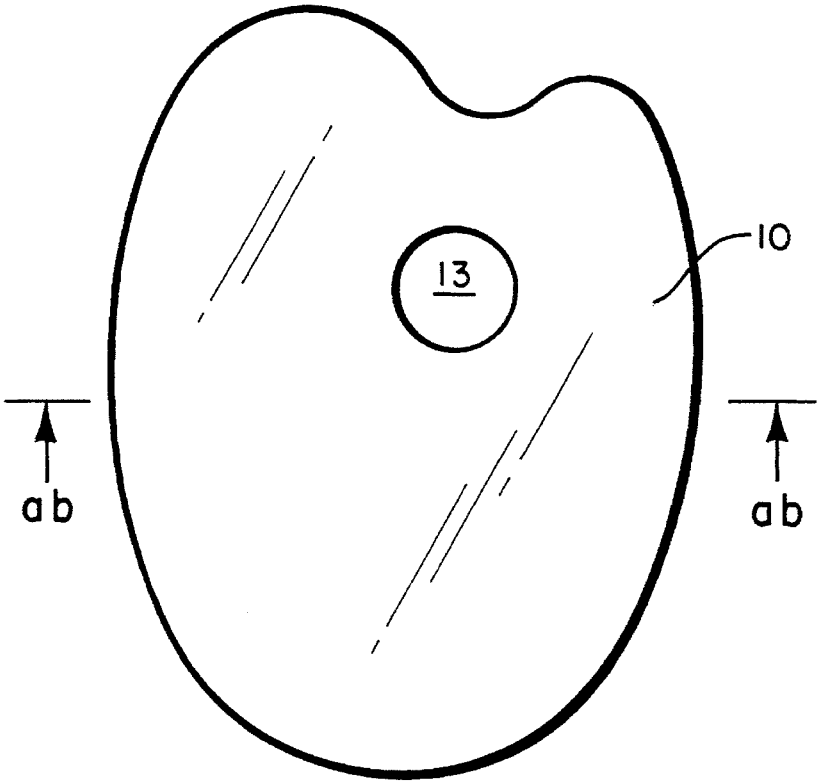
FIG. 1 illustrates a plan view of a palette having a classic shape but with a white vinyl layer laminated on the back as shown in a cross-sectional view in FIG. 1*a* or with a textured back as shown in a cross-sectional view shown in FIG. 1*b*, both taken on a line ab—ab in FIG. 1.
Figure 2:
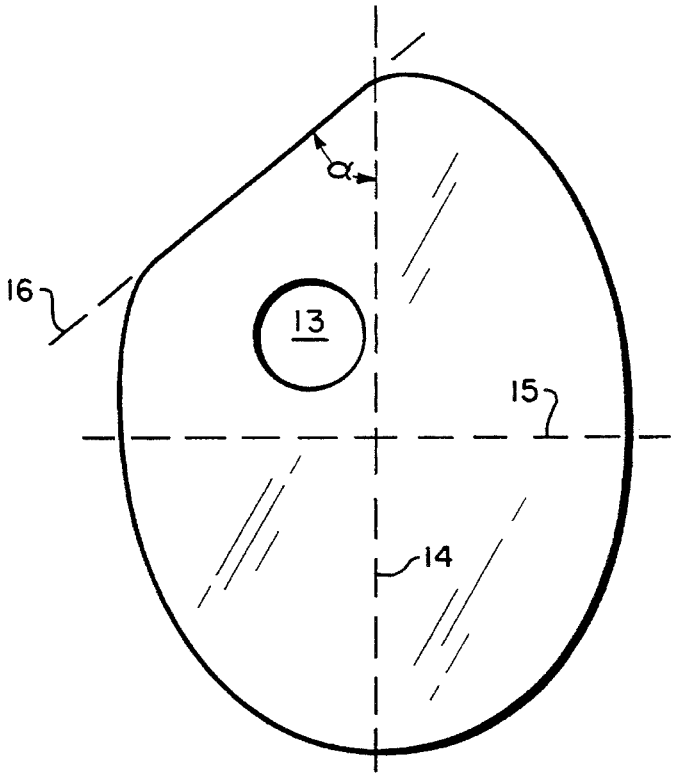
FIGS. 2 and 3 illustrate alternative shapes for the palette of FIG. 1.
Figure 3:
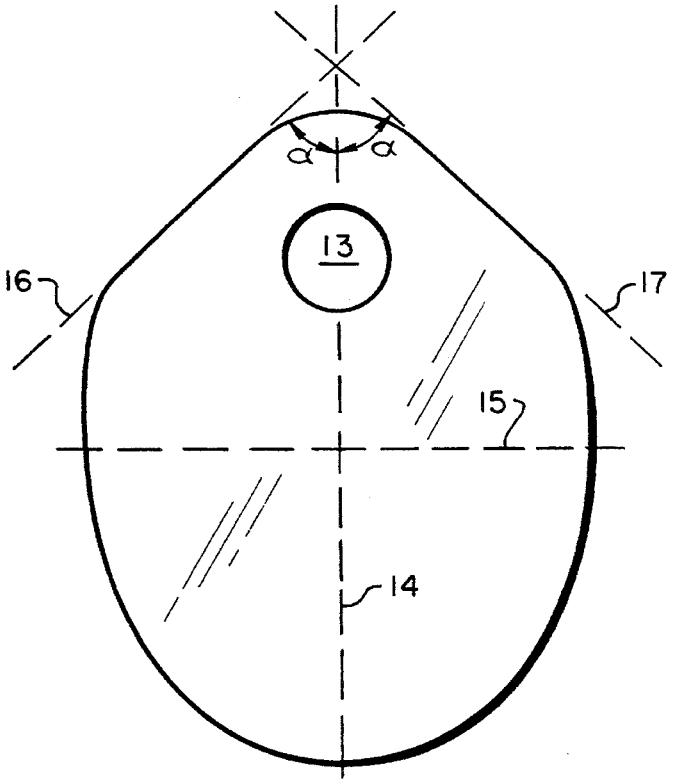
Figure 4:
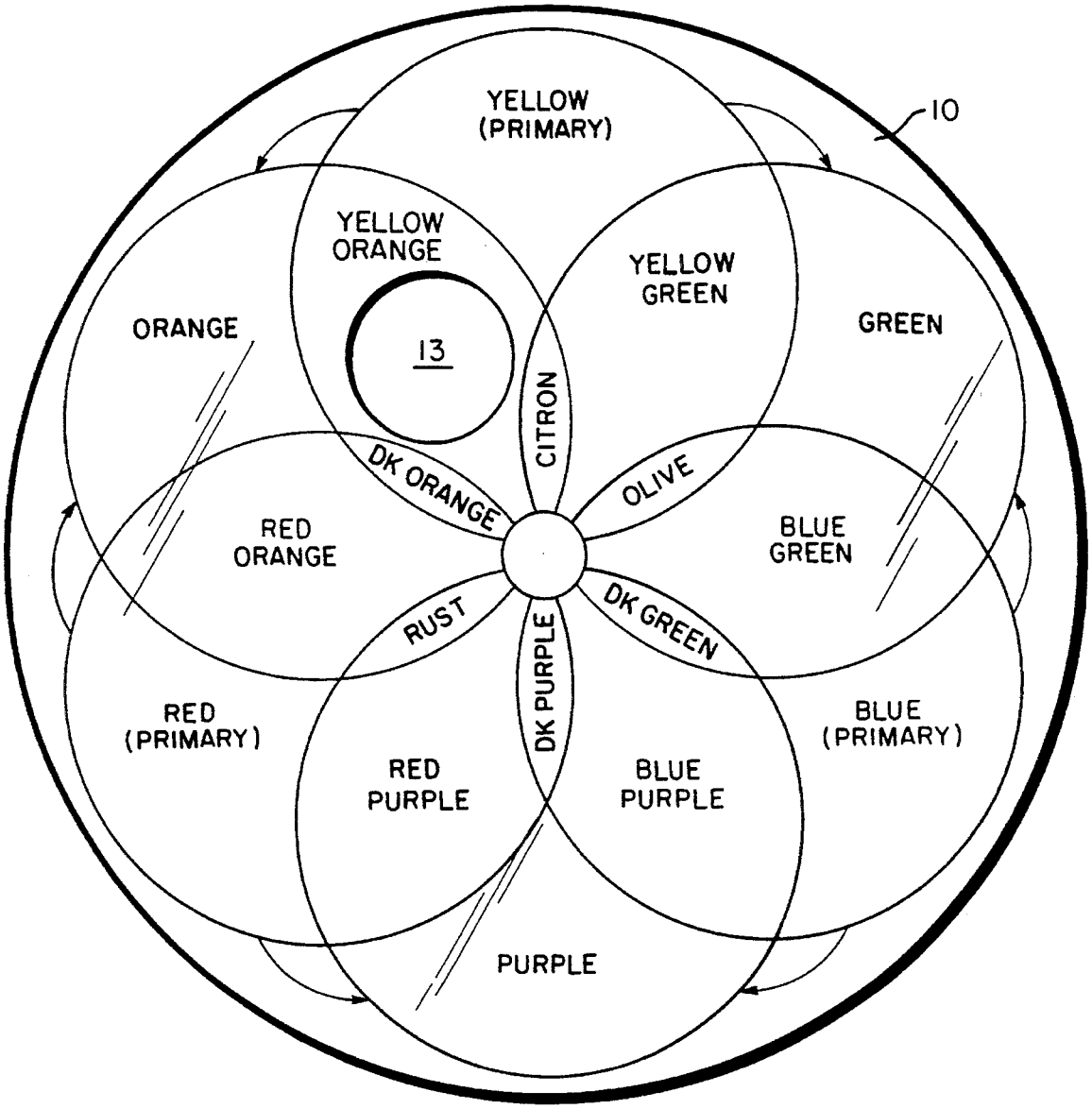
FIG. 4 illustrates a palette of yet another alternative shape with a vinyl layer prepared with a printed color mixing guide laminated on the back.
Figure 5:
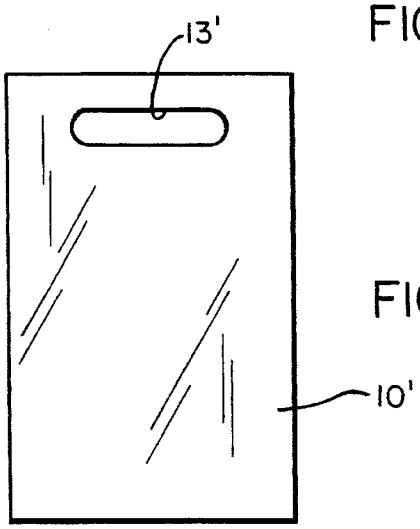
FIG. 5 illustrates the shape of a table-top palette with a white vinyl layer on the back and a carry handle.

FIG. 1 illustrates in a plan view a classic shape of a flat palette used by artists to mix and/or hold paint colors while painting with oil or acrylic paints or with any one of a variety of inks. This classic shape shown in FIG. 1 and alternative shapes shown in FIGS. 2, 3 and 4 are suitable for the present invention. However, it should be understood that the present invention is not limited to any particular shape. For example, they may be rectangular, with or without a carrying handle, for use as a table-top palette, as shown in FIG. 5.

Figure 1A:
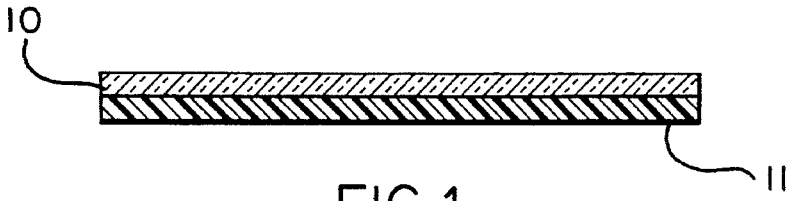
Figure 1B:
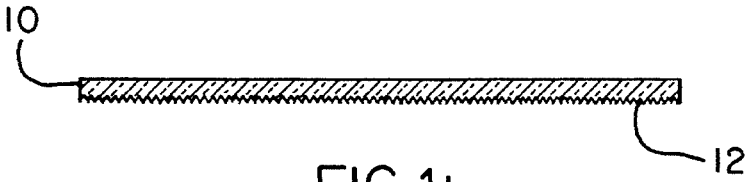

While these and other shaped palettes have in the past been made out of a variety of rigid materials, such as aluminum, wood, masonite and the like, the present invention comprises a sheet 10 of tempered glass with a layer 11 of vinyl laminated onto the reverse side of the palette 11, as shown in a cross-sectional view in FIG. 1*a* taken on a line ab—ab in FIG. 1. The thickness of the glass is preferably ⅛" and the thickness of the vinyl is less than 1/32", preferably 1/16", but the thicknesses are exaggerated in the drawings for ease of illustration. The white vinyl reflects light entering the glass and thus provides a background of diffused light against which the artist may view the paints in their true color as they are being mixed. Alternatively the palette may comprise a sheet 10 of tempered glass with a textured surface 12 on the back to diffuse light entering the glass from the back. In either case, light reflected by the white vinyl layer and light diffused by the textured surface on the back, diffused light at the front surface of the palette will assist in viewing the colors held or mixed on the front surface in their true colors.

A thumb hole 13 in each of the palettes shown in FIGS. 1 through 4 is provided to assist in holding the palette on the forearm. The classic shape and position of the thumb hold shown in FIG. 1 is intended for carrying the palette while in use on the left forearm, but the shape may be readily reversed to its mirror image for a left-handed person to carry the palette on the right forearm. The same is true about the palette shown in FIG. 2, which is shown with a shape and thumb hole position for a left-handed artist. The palette shapes shown in FIGS. 3 and 4 are symmetrical along a line from the center of their thumb holes 13 to their farthest edge so that they may be carried with equal ease on either forearm which may be an advantage for ambidextrous artists who may wish to switch the brush from one hand to the other to avoid fatigue.

The palette shown in FIG. 4 has a color chart printed on the white vinyl layer laminated on the back so that it may be viewed from the front through the tempered glass. This or other color mixing guide may be printed in this manner on any of the tempered glass palettes shown in FIGS. 1 through 5, as well as that shown in FIG. 5, which is a table-top palette 10 with a hand-hold opening 13' for carrying it, although that is not necessary for a palette that is not often moved in the studio.

The palette shown in FIG. 2 is quasi-elliptical with a major axis 14 greater than a minor axis 15 and an end thereof truncated along a line 16 at an angle α. A thumb hole 13 is positioned near the line 10 of truncation at approximately the same distance from the major axis 14 and the minor axis 15 to permit an artist to hold the palette on one arm (the right arm in this example) while painting with the other arm (the left arm in this case).

The palette shown in FIG. 3 is also quasi-elliptical in shape with a major axis 14 and a minor axis 15. In this example, the quasi-elliptical palette is truncated at one end along two lines 16 and 17 at an equal angle α with the major axis, and a thumb hole 13 is centered near the edge of the palette on the major axis. An artist may then support the palette on either arm while painting with the other arm. The artist's thumb protrudes up through the thumb hole in this and other examples of the invention to secure the palette on the supporting arm by a light grip between the thumb and index finger of the hand.

In the case of the table-top palette of FIG. 5, it may not be necessary to laminate a vinyl sheet on the back nor to provide a textured surface on the back because it is intended that the back will be placed on a flat surface that will reflect light, particularly a white surface, or on a sheet of white paper on the table top. In that case, as well as in any of the other palettes shown in FIGS. 1 through 4, the color mixing guide may be silk screened onto the back of the sheet of tempered glass.

Although particular embodiments of the invention have been described and illustrated herein, it is recognized that modifications and variations may readily occur to those skilled in the art. Consequently, it is intended that the claims be interpreted to cover such modifications and equivalents.

What is claimed is:

1. A rigid palette comprising a flat sheet of translucent glass for mixing paints or inks of different colors on a front surface thereof and means for providing diffused light through a back surface thereof to illuminate said paints or inks mixed on a front surface thereof said sheet further including a thumb hole near an edge thereof for an artist to support said palette on one arm while standing or sitting to paint with the other arm.

2. A palette as defined in claim 1 wherein said means for providing diffused light through a back surface thereof comprises a white opaque material behind said backside of said sheet of glass for scattering light back through said backside of said sheet of tempered glass to the front side thereof where said paints and inks are being mixed.

3. A palette as defined in claim 1 wherein said means for providing diffused light through a back surface thereof comprises a texture formed on said back surface of said sheet of tempered glass to the front side thereof where said paints and inks are being mixed.

4. A palette as defined in claim 2 wherein said white opaque material is laminated on said backside of said sheet of glass, and including a printed color mixing guide disposed at an interface between said white opaque material and said sheet of glass.

5. A palette as defined in claim 4 wherein said sheet of glass is circular.

6. A palette as defined in claim 1 wherein said sheet of glass is elliptical with a major axis greater than a minor axis thereof by a factor less than two and an end thereof truncated along two lines at equal angles on each side of said major axis, said end being truncated to a limited extent so as to leave a curved edge between truncations along said two lines, and wherein said thumb hole is centered on said major axis near said curved edge between said truncations, whereby said palette may be supported on either arm of an artist with equal ease while painting with the other arm not supporting said palette.

7. A palette as defined in claim 1, said sheet of glass being circular and wherein said thumb hole is positioned near an edge thereof for an artist to support said palette on one arm while standing or sitting to paint with the other arm not supporting said palette.

8. A palette as defined in claim 1, said sheet of glass being quasi-elliptical with a major axis greater than a minor axis thereof by a factor less than two and an end thereof truncated along a line at an angle α with said major axis, and positioned near said line of truncation at approximately the same distance from said major and minor axes for an artist to support said palette on one arm while standing or sitting to paint with the other arm.

* * * * *